US005657646A

United States Patent [19]

Rosenberg

[11] Patent Number: 5,657,646

[45] Date of Patent: Aug. 19, 1997

[54] JEWEL HAVING MULTIPLE CULETS

[76] Inventor: Steven F. Rosenberg, 3920 Mystic Valley Pkwy., Medford, Mass. 02155

[21] Appl. No.: 318,058

[22] Filed: Oct. 4, 1994

[51] Int. Cl.[6] ..... A44C 17/00

[52] U.S. Cl. ..... 63/32

[58] Field of Search ..... 63/32; D11/90

[56] References Cited

U.S. PATENT DOCUMENTS

| | | | |
|---|---|---|---|
| D. 196,868 | 11/1963 | Nagy | 63/32 |
| D. 277,942 | 3/1985 | Valckx | 63/32 |
| D. 340,667 | 10/1993 | Schachter | D11/90 |
| D. 340,668 | 10/1993 | Schachter | D11/90 |
| 4,118,949 | 10/1978 | Grossbard | 63/32 |
| 4,118,950 | 10/1978 | Grossbard | 63/32 |
| 4,306,427 | 12/1981 | Urban | 63/32 |
| 4,555,916 | 12/1985 | Grossbard | 63/32 |
| 4,708,001 | 11/1987 | Alburger | 63/32 |
| 5,462,474 | 10/1995 | Hansen | 63/32 |

FOREIGN PATENT DOCUMENTS

| | | | |
|---|---|---|---|
| 1005060 | 9/1965 | United Kingdom | 63/32 |

*Primary Examiner*—Michael J. Milano

[57] ABSTRACT

A gem cut with crown facets and base facets has a table and a principal culet located along the longitudinal axis of the gem. In addition, at least one additional culet is provided between the end of the gem and the principal culet. Extending from the extra culet to the end of the diamond, at the girdle, is an end base facet. Preferably, the end base facet is at the 41° desired angle for diamonds. As so cut, the gem exhibits enhanced brilliance and the bow-tie dullness associated with side split facets is reduced resulting in overall enhanced brilliance to the stone. In the preferred embodiment of the invention, the girdle of the stone is provided with eight straight edges and the girdle is symmetrical about both the longitudinal axis and the perpendicular cross axis. In this embodiment, a pair of extra culets and end base facets are provided. According to the preferred embodiment of the invention, the end base facets are further provided with end base split facets for further enhanced brilliance.

25 Claims, 6 Drawing Sheets

JEWEL HAVING MULTIPLE CULETS

BACKGROUND OF THE INVENTION

This invention relates to a new cut for a precious or semi-precious jewel. Cut in accordance with the present invention, the jewel displays enhanced overall brilliance. Specifically, by providing two or more culets to a gem, along with a plurality of ordinary facets, and having at least one additional facet extending from the end of the jewel to the extra culet, at the preferred 41° angle (for diamonds) the brilliance of the gem is enhanced. In addition, the "bow-tie"of darkness, which ordinarily appears in brilliant cut gems having a single culet is reduced in that the gem, cut with two or more culets and two or more additional facets at 41°, distributes the bow-tie "darkness" among the other facets. In this manner, the overall brilliance of the stone is apparently enhanced.

A jewel's brilliancy is generally divided into two types, namely internal and external. External brilliance is often referred to as the luster of the diamond. When a ray of light strikes the table or top surface, it is split into two partial light rays, one penetrating into the surface of the gem and the other reflecting off the stone. The angle of reflection is generally equal to the angle of incidence of light, a consequence of the index of refraction and mirror aspects of a diamond, when appropriately cut and polished. Internal brilliance, on the other hand, is caused by the light rays which enter generally through the crown of the gem and its associated table area. These light rays are refracted, internally of the gem, and then reflected by the base facets back through the crown and table area as undispersed light. The refracted index for a diamond is 2.42. This allows for a small critical angle. This angle, in turn, allows for a ray of light striking the base facet to be totally reflected out through the top, crown and table area, of the stone. This is only possible if proportions are kept within the critical angle.

Precious gems, it is well known, are cut with a plurality of facets at predetermined angles. The facets and angles are intended to enhance the light reflecting and refracting aspects of the gem. Studies indicate that a gem's brilliance can be significantly enhanced when the facets are made at angles which take into account the gem's index of refraction. Consistent with standard and conventional gem-cutting techniques, diamonds, rubies, sapphires and emeralds have been traditionally cut with a single culet and a plurality of facet faces beneath the girdle of the stone which are directed toward the culet. This cut has, in the past, provided maximum light refraction within the gem with maximum light emanating through the table of the gem. High brilliance is a very important factor in a gem's value.

The present invention contemplates the cutting of two or more culets on the bottom of a precious stone, along an axis of symmetry. This allows the provision of at least two additional, end base facets to be cut at the 41° angle, the preferred angle for diamond refraction. This angle has been determined to be the preferred angle in diamond cutting for base facets. This, it has been determined, provides for maximum brilliance of the gem. The 41° angle for the additional base facets provided by the cutting of additional culets, consistent with the present invention, reduces the bow-tie "dullness" or darkness at the sides of the diamond and, further, distributes the gem's brilliance more uniformly around the entirety of the stone. Furthermore, the brilliance of the gem can be enhanced by the use of extra side split facets. The effect is enhanced further by additional base end split facets.

DESCRIPTION OF THE PRIOR ART AND SUMMARY OF THE INVENTION

Tolkowsky was probably the first person to make use of the prismatic effect of a diamond, when cut to pre-determined angles and proportions. The crown and table facets were used to allow light to enter the stone. The base facets, below the girdle, act like mirrors, and reflect the light entering the stone back out again, through the top of the stone. The modern brilliant stone has been designed to produce the maximum amount of scintillation, brilliancy and dispersion, to be viewed once the stone has been mounted. This covers an arc across the crown from girdle to girdle. Optimum results are obtained by the blending of portions and angles with a practical view toward weight retention of the jewel.

Gem cutting, for the purposes of this invention, is described with respect to diamonds. These gems, when properly cut, take advantage of the fact that a cut diamond is like a prism. Light entering the table or crown of the diamond is trapped inside and deflected at pre-determined angles off the underside on the base facets. The light is then reflected back and up through the table and crown facets. This means that the greatest amount of light enters through the table and the base main facets are so angled and positioned so as to reflect light back through the table and crown. This gives the round cut diamond maximum light reflection when viewed from the table. Optimum "life" of the diamond is obtained when maximum scintillation, brilliancy, and dispersion are evenly projected across the top or crown of the stone. Scintillation, in this context, is the amount of flashes which can be observed radiating from the diamond when the eye, light source or stone moves. These flashes are composed of changing colors created by the number of facets, their position and type, i.e., the base facets of the brilliant cut as opposed to the step cut facets.

It is, therefore, a principal object of the present invention to more evenly distribute the scintillation, brilliancy and dispersion of the light through and out the crown of the stone. "Fire" of a diamond is caused by the amount of dispersed light which leaves the stone after reflection and refraction. Dispersion is the separating of the white light into the spectral colors. A ray of light passing through the sloped face of a prism will split up into the various spectral colors. When a ray of light is totally reflected from the base facets and strikes the table or ground facets at the greatest possible angle, dispersion is at its greatest. This is one reason why diamond viewing is so enjoyed. It is a visual light show, when the viewer's eye or the cut diamond is moved relative to one another.

Providing an appropriate crown and base angle to a diamond is the key to maximizing the "life" of the diamond. Brilliancy is, of course, a key factor in the life of the diamond. Brilliancy is dominated by table size. Small tables produce more luster and less internal brilliancy. On the other hand, larger or "spread" tables, to a degree, increase internal brilliancy and result in less luster. The correct proportions produce maximum scintillation and dispersion. The present invention is intended to increase brilliance of the diamond by adding two additional base facets both at a 41° angle to the table. The extra base facets extend from the ends of the jewel to the additional culets. The culets are located along the longitudinal axis of the gem.

To understand internal brilliancy of a gem or diamond caused by total light reflection, it is necessary to study the path of light after it enters the table. As light strikes the table perpendicularly, that which strikes the outer area of the table will return through the crown end facets on the opposite side of the gem while light striking the central area within the table will return through the table, again, on the opposite side. A stone cut with a 66 and ⅔% table with respect to the overall longitudinal dimension of the stone, a 33°–34° crown angle and a 41° base angle, with respect to the table, will produce an equal flow of reflected light through the table and its crown end facets. This total balance of light reflection can fool the human eye into the belief that the stone has "life." When these relative proportions are used, a visual pleasing appearance is provided. It is a basis for the diamond's value. The diamond, however, is extremely sensitive to any change in the base angle of 41° such that having the angle less than the desired 41° will produce a fish eye effect while a base angle slightly greater than 41° will produce a dull, inner light circle when the gem is viewed from the table.

Thus, it should be appreciated by those of ordinary skill in the art that providing an additional base facet to a gem, the facet extending from the longitudinal edge to an additional culet provided at the base of the gem, where the extra facets are at the desired angle of 41° will produce increased brilliance to the stone. That is the basis of the present invention.

Furthermore, it has been determined that the bow-tie dullness appearing in cut stones, particularly diamonds provided with side split facets, can be reduced by more evenly dispersing the reflection of light among all of the facets of the stone. This is enhanced by the provision of the additional base facets at the desired 41° angle. The extra facets can be provided, a consequence of the provision according to the present invention of a stone cut with two or more culets along a longitudinal axis of the base.

It is, therefore, an object of the present invention to produce a new gem cut for semi-precious or precious stones. It is a further object of the present invention to provide a new gem cut for diamonds, emeralds, sapphires and rubies.

It is an object of the present invention to provide a new gem cut having two or more culets along a symmetrical line. In this manner, as will be discussed and illustrated, additional 41° base facets are provided to the gem and the overall brilliancy of the gem is enhanced.

It is a further object of the present invention to reduce the bow-tie effect appearing in many cut stones. More specifically, in those gem cuts which are not rounds, a first symmetrical axis is generally of longer length than the perpendicular cross axis. By providing two or more culets to the base of the gem, along the longitudinal axis, additional base facets are provided at the desired 41° angle. This, it has been determined, provides overall enhanced brilliance. In addition, the use of the two or more culets and the additional end facets distributes the dullness at the bow-tie area which is otherwise normally observable.

Toward this end, the present invention contemplates providing a cut diamond or gemstone with two or more culets. By providing additional culets to a cut gem, along the longitudinal axis, additional base facets at the predetermined 41° angle of refractivity can be utilized. The use of the additional base facets, extending from the girdle to additional culets, distributes the brilliance of the gem more uniformly and, therefore, apparently enhances the gem's overall brilliance.

These and other objects will become readily apparent in connection with a full consideration of the drawings and descriptions as follows:

DETAILED DESCRIPTION OF THE DRAWINGS AND THE PREFERRED EMBODIMENT

Briefly stated, the present invention relates to the provision of two or more culets to the base of a gem. The culets are formed along the longitudinal base axis. The extra culets allow additional base facets, preferably cut at the desired 41° angle. The new base facets extend from the girdle, along the gem's base, to the additional culets. A center culet is still provided for those gems warranting an odd number of total culets. However, according to the dimensions of the gem, at least one additional culet is provided to the gem. Extending from the edge of the stone, at the girdle, to the additional culets, are facets at the desired 41° angle. These facets reduce the bow-tie dullness or black areas at the sides of the gems and, further, distribute the brilliance of the gem more evenly around the entirety of the diamond. This increased brilliance is even further enhanced by the use of additional split crown facets. The end base facets can also be provided with split facets.

Figure 1:
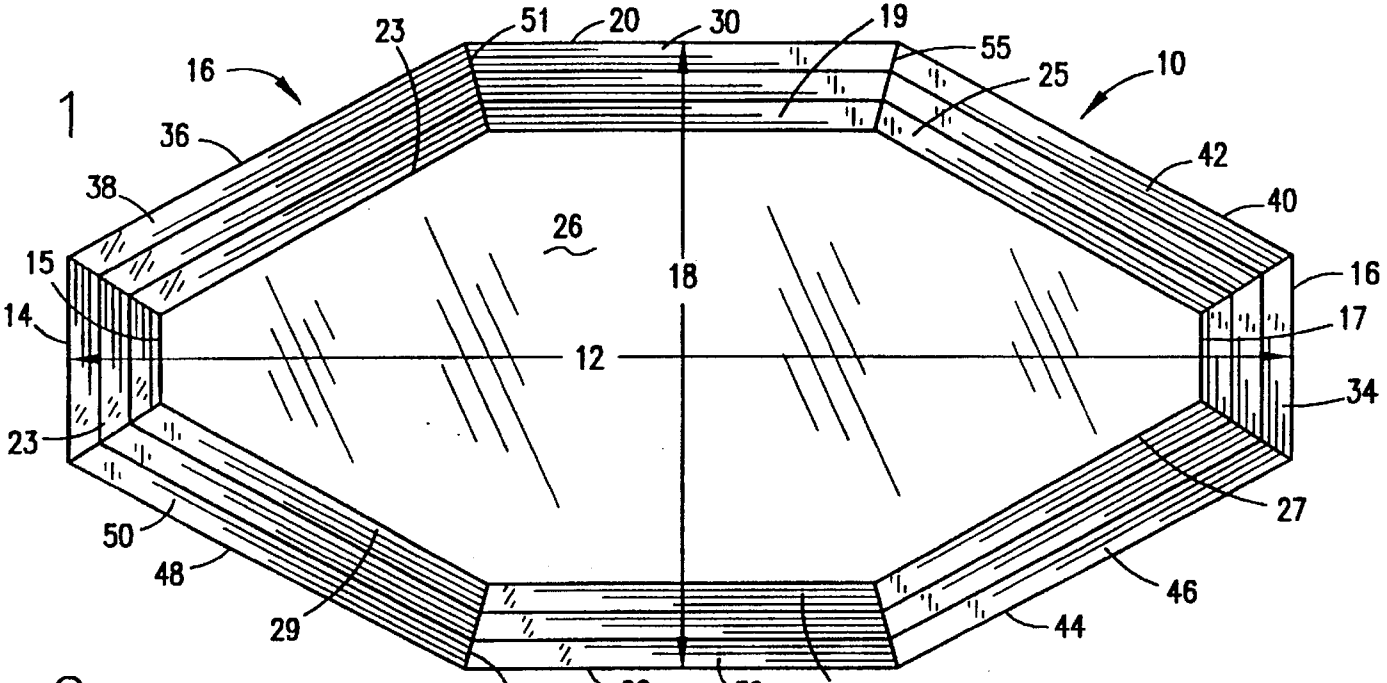
FIG. 1 is a top plan view of the preferred embodiment of the multiple-culet gem.

As best seen in FIG. 1, a gem, preferably a diamond 10 is formed as an irregular octagon or an eight-sided polygon. The gem 10 shown in FIG. 1 has a longitudinal axis 12 extending from end edge 14 to opposed end edge 16 and a short cross-axis 18, extending from side edge 20 to opposed side edge 22. The axis are determined at the gem's girdle. As can be readily appreciated, the longitudinal axis 12 is longer in dimension than the cross-axis 18. The longitudinal axis 12, for the purposes of this discussion, is defined at the horizontal plane of the gem conventionally referred to as the girdle 24 (see FIG. 2). The table 26 of the gem refers to that flat, horizontal planar surface confined within the crown facets. The crown facets are defined by edges 14, 16, 20, 22 and angled edges 36, 40, 44 and 48, on the outside, and inside end and side edges 15, 17, 19 and 21, respectively, and inside angled edges, 23, 25, 27 and 29. End facet 28 is defined by edge 14 and inside end edge 15 while opposed end facet 34 is defined by end edge 16 and inside edge 17. Crown side facet 30 is defined by side edge 20 and inside edge 19 while opposite side crown facet 32 extends between side edge 22 and inside edge 21. Located opposite to crown end facet 28 is the second crown end facet 34. In clockwise direction from end edge 14, proceeding around the gem 10, at the plane of girdle 24, is first angled edge 36 defining with inside angled edge 23 of table 26, first angled facet 38; second angled edge 40, defining along with inside angled edge 25 of table 26, second angled facet 42, third angled edge 44, defining along with inside angled edge 27 of table 26, third angled facet 46; and fourth angled edge 48, defining with inside angled edge 29 of table 26, fourth angled facet 50.

Figure 2:
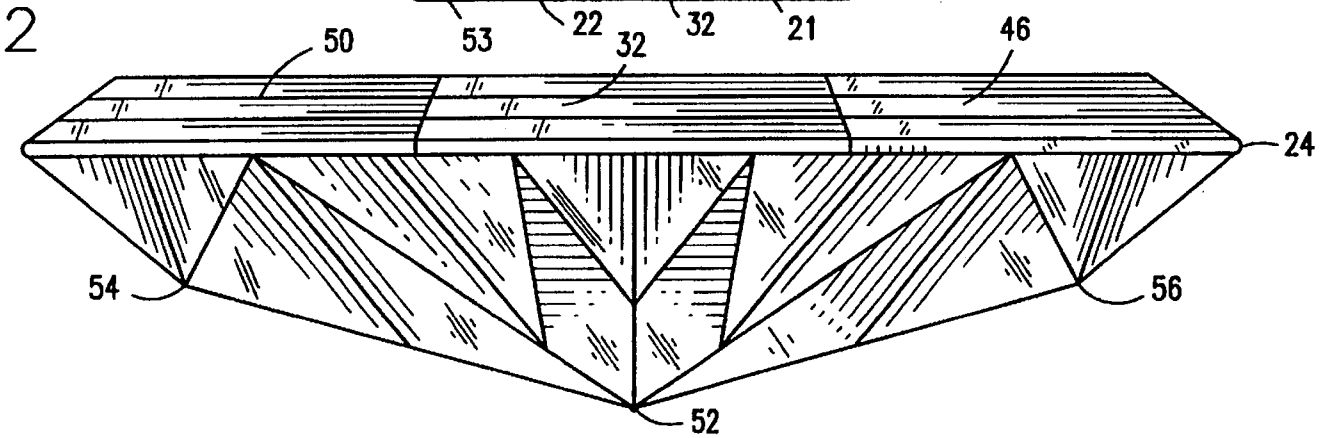
FIG. 2 is a side plan view of the embodiment of the invention shown in FIG. 1, the opposite side being substantially identical.
Figure 3:
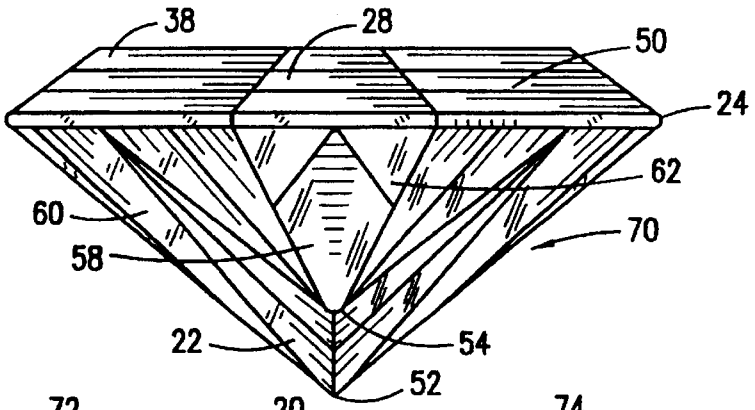
FIG. 3 is an end plan view of the embodiment of the invention shown in FIGS. 1 and 2, the other end view being substantially identical.

As can be readily seen and appreciated by a review of FIGS. 1–3, the angled and inside angled edges as well as the angled facets, 38, 42, 44 and 50, extend between the end edges, inside end edges, side edges and inside side edges, as well as the crown end facets and crown side facets. Also, as can be readily appreciated from FIG. 1, first and second angled facets 36 and 42, respectively, are mirror images, about longitudinal axis 12, with respect to third and fourth angled facets 46 and 50.

With respect to the shorter cross-axis 18, it will be further appreciated that first angled edge 36 and first angled facet 38 are the mirror image of second angled edge 40 and second angled facet 42. Similarly, with respect to cross-axis 18, third angled edge 44 and third angled facet 46 are the mirror image of fourth angled edge 48 and fourth angled facet 50.

In the preferred embodiment of the present invention, the crown end facets, 28 and 34, crown side facets, 30 and 32, and the first, second, third and fourth angled facets, 38, 42, 46 and 50, respectively are step-cut. Preferably, three steps are provided to each of the facets in a conventional step-cut manner, preceding from the girdle, such that each one-third of the facet, progressing toward the table, has a less inclined angle of inclination.

FIG. 2 shows a side view of gem 10. As can be easily appreciated by a consideration of the drawings, the present invention contemplates, for this embodiment, a center point culet 52 on the base of the gem and located on the point defined by the intersection of vertical planes passing through both longitudinal axis 12 and cross-axis 18. In addition, located along a vertical plane passing through longitudinal axis 12, in the example of the invention shown in FIGS. 1–4, are a second and a third point culet 54 and 56. Consistent with the preferred embodiment of the present invention, additional culet 54 (located on the vertical plane passing through the longitudinal axis 12) is located between end edge 14 and the intersection 51 between side edge 20 and first angled edge 36 as well as, of course, between end edge 14 and intersection 53, located between opposed side edge 22 and fourth angled edge 48. The third culet 56, similarly, is located, again, on a vertical plane passing through longitudinal axis 12, between the intersection 55 of side facet 30 and second angled facet 42.

Figure 4:
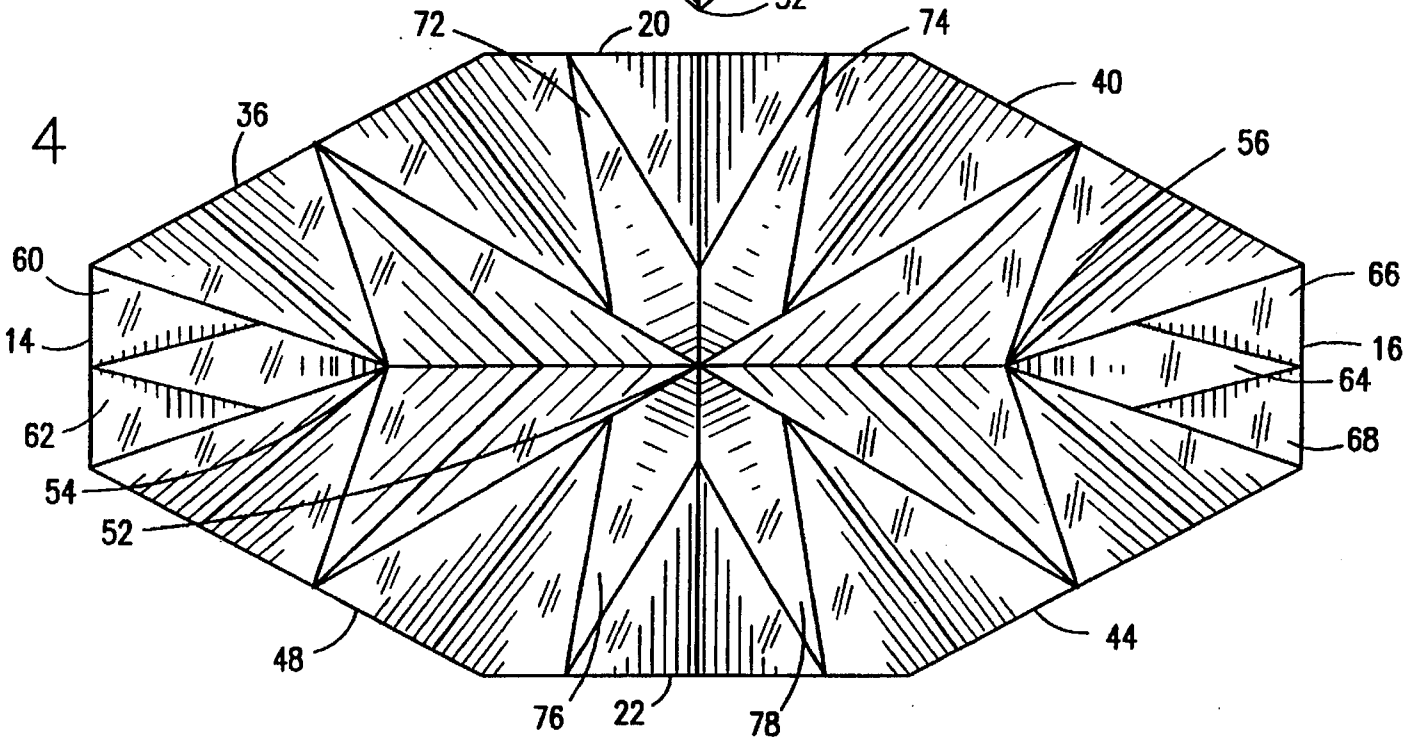
FIG. 4 is a bottom elevational view of the invention shown in FIGS. 1, 2

As seen in FIG. 4, extending between end edge 14 at girdle 24 and first additional culet 54, is an end base facet 58. In the preferred embodiment of the present invention, the end base facet is provided with end base split facets 60 and 62. Similarly, located between end edge 16 at the girdle 24 and the second additional culet 56 is a second end base facet 64. According to the preferred embodiment of the present invention, the second end base facet 64 can also be provided with a pair of end base split facets 66 and 68.

The entire base 70 of the gem 10 is provided with multiple base facets extending between the side edges 20 and 22, the angled edges 36, 40, 44 and 48 and the center culet 52, first additional culet 54 and second additional culet 56. These are shown in FIG. 4. According to the present invention, two pairs of opposed side split base facets 72, 74, and 76 and 78 form a "bow-tie" which, as a consequence of the additional end base facet 58 and the second end base facet 64 is diminished in its dullness, thereby resulting in increased overall brilliance to the gem, a consequence of dispersing the dullness more uniformly across the entirety of the stone. End base facets 58 and 64 are preferably at the 41° angle with respect to the table.

Figure 5:
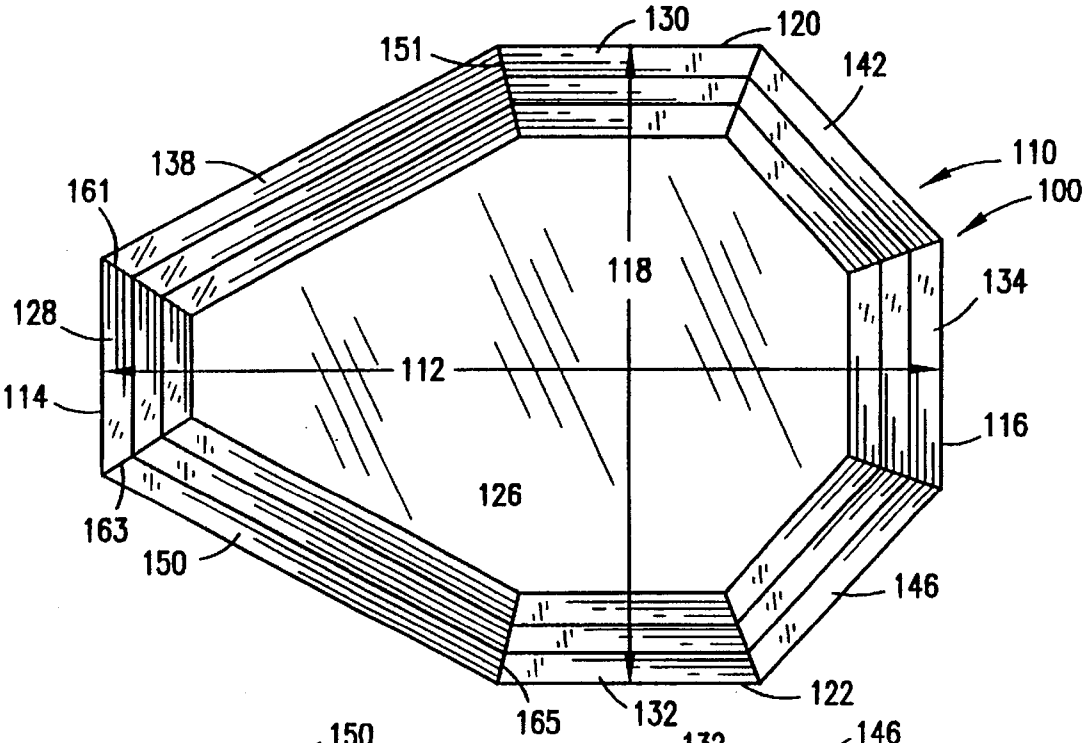
FIG. 5 is a top plan view of a second embodiment of the present invention.

A second embodiment of the present invention is illustrated in FIGS. 5–9. FIGS. 5–9 illustrate an alternate embodiment of the present invention wherein the basic gem shape is pear shape. To facilitate an understanding of this second embodiment of the present invention, the reference numerals and identification of the elements in this second embodiment are substantially the same as those used with respect to that embodiment of the invention shown in FIGS. 1–4 with the exception that the reference numerals have now been augmented by 100. Gem 110 corresponds, in basic configuration, to a conventional more rounded-edged pear shape diamond. As best seen in FIG. 5, a longitudinal axis 112 extends between end edge 114 and the opposed end edge 116. A short cross-axis 118 extends between opposed side edges 120 and 122. The pavilion of the gem is comprised of a pair of opposed step-cut crown end facets 128 and 134; crown side facets 130 and 132, and crown angled facets 138; 142; 146 and 150, respectively. The table 126 is defined by the inside edges of the crown facets. Located on the gem, at the intersection of the vertical planes passing through longitudinal axis 112 and cross-axis 118, is the main culet 152 (as best seen in FIGS. 6–9).

Figure 6:
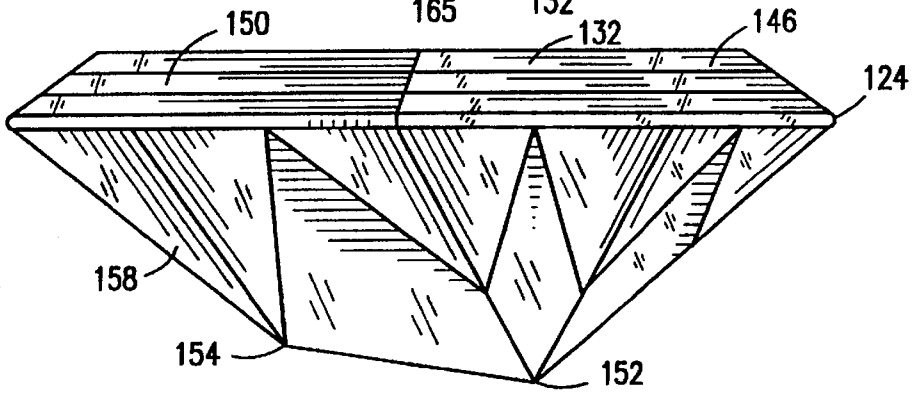
FIG. 6 is a side elevational view of the embodiment of the invention shown in FIG. 5, the other side elevational view being a mirror image thereof.
Figure 8:
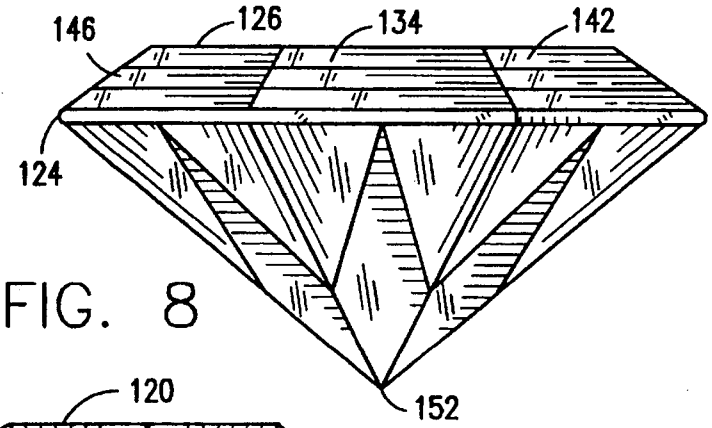
FIG. 8 is an end plan view of the embodiment of the invention taken from the right side of the gem shown in FIGS. 5 and 6.

In addition, a second culet is formed, along longitudinal axis 12, between the intersection 151 and line 161, bordering the first angled facet. The second or additional culet 154 is shown in FIGS. 6, 7 and 9.

Figure 7:
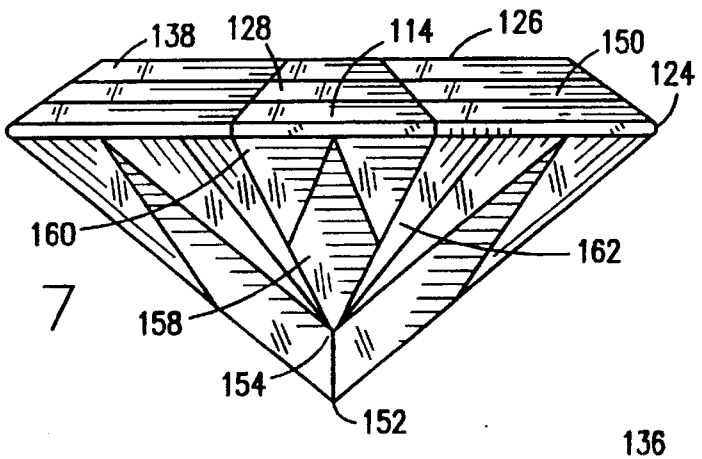
FIG. 7 is an end plan view of the embodiment of the invention taken from the left side of the gem shown in FIGS. 5 and 6.
Figure 9:
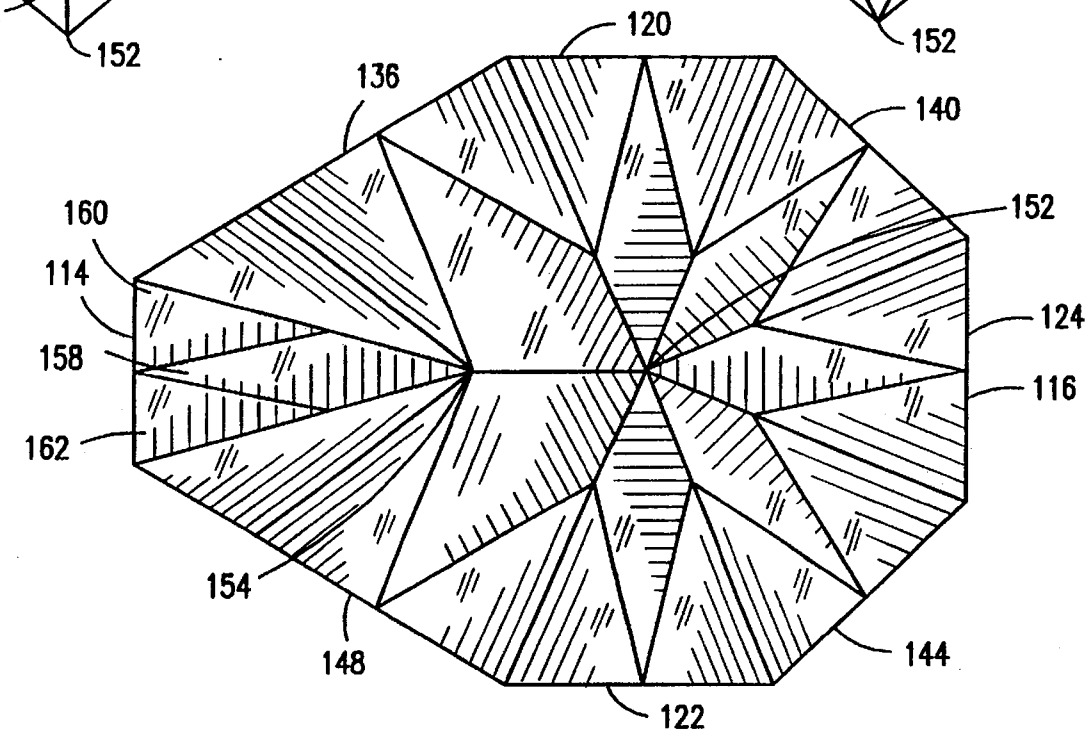
FIG. 9 is a bottom elevational view of the gem shown in FIGS. 5–8.
Figure 10:
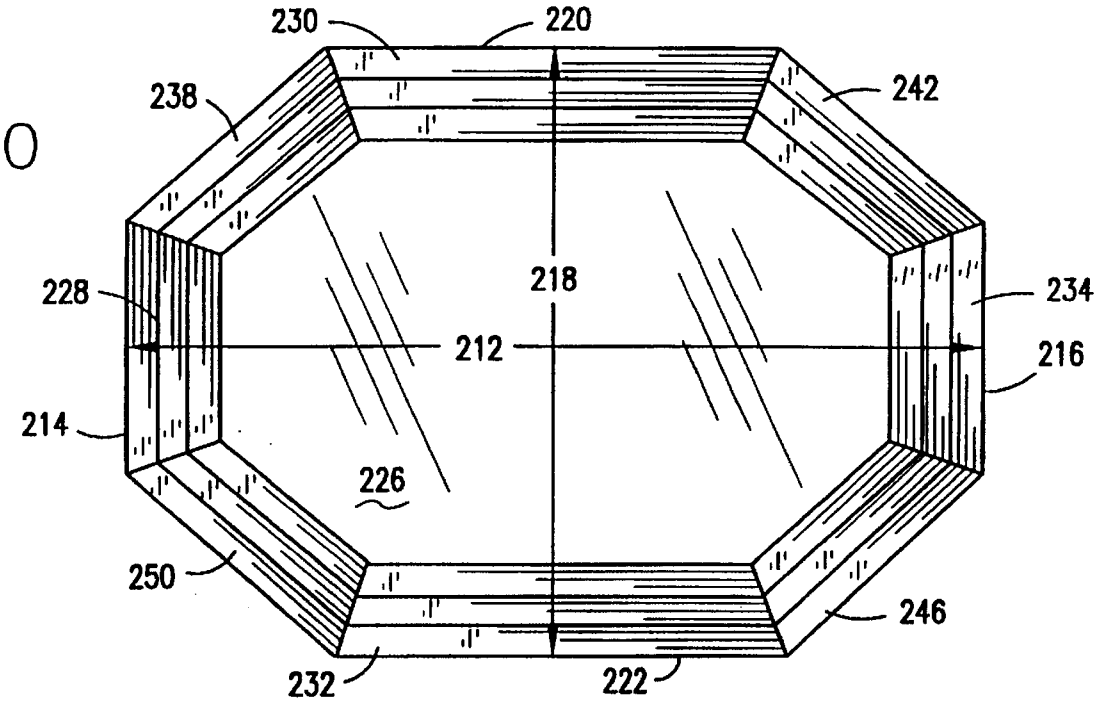
FIG. 10 is a top plan view of a third embodiment of the present invention.
Figure 11:
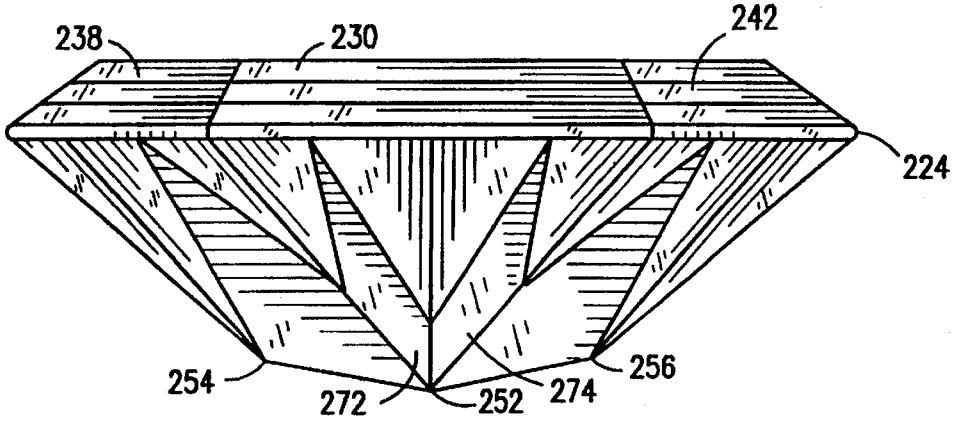
FIG. 11 is a side elevational view of the gem shown in FIG. 10 with the opposite side being substantially the same.
Figure 12:
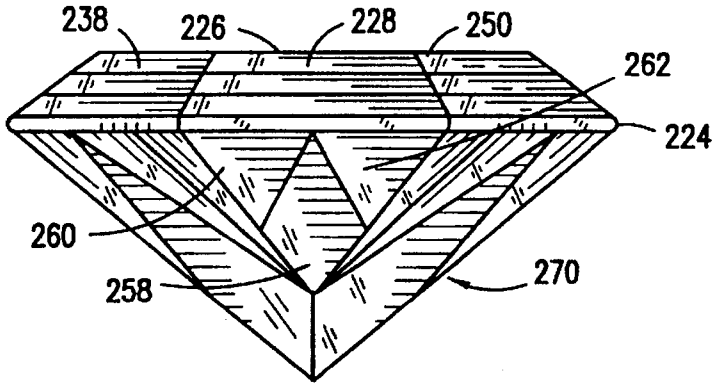
FIG. 12 is an end plan view of the gem shown in FIGS. 10 and 11 with the other end plan view being substantially identical thereto.
Figure 13:
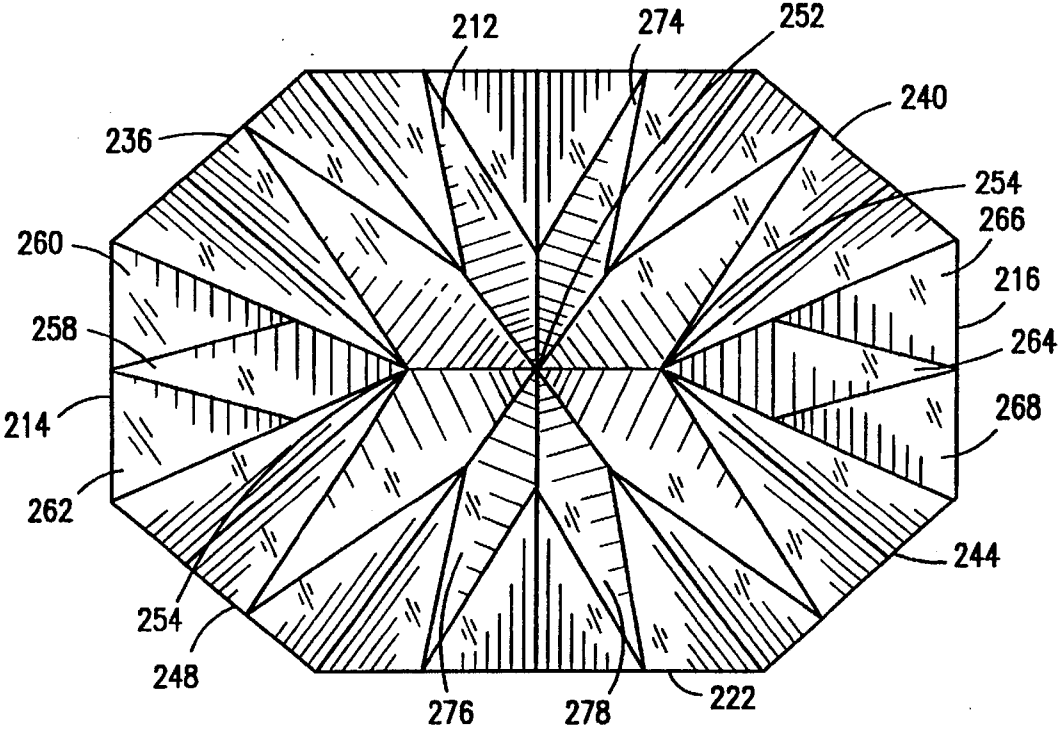
FIG. 13 is a bottom elevational view of the gem shown in FIGS. 10–12.

As best seen in FIGS. 7 and 9, an end base facet 158 is provided and extends between end edge 114, at girdle 124 and the additional culet 154. According to the preferred embodiment of the present invention, the end base facet 158 can be provided with end base split facets 160 and 162. As previously discussed, the end base facet 158 is preferably provided at the preferred angle of 41°, consistent with standard diamond cutting practice. This creates greater brilliance to the gem and, in addition, reduces any bow-tie dullness by facets at the sides of the gems.

FIGS. 10–13 show yet another embodiment of the present invention. Here, again, an eight-sided gem is shown. This embodiment corresponds to a basic emerald cut. In this embodiment, however, a single center culet 252 is provided and, in addition, two additional culets 254 and 256, as well. For ease of illustration, the reference numerals and terminology used with respect to FIGS. 14 have again been used with regard to FIGS. 10–13, however, the reference numerals have this time been augmented by 200. The end base facets 258 and 264 (See FIGS. 12 and 13) extend between the end edges and the additional culets 254 and 256. They provide increased brilliance to the diamond cut. In addition, as mentioned, the use of these extra end base facets reduces the bow-tie dullness otherwise apparent in side split facets 272, 274, 276 and 278. The end base facets are preferably cut at the 41° angle to the table. Also, the end base facets can be split, as shown by split end facets, 260, 262, 266 and 268.

While the invention has been described with reference to specific embodiments, the description is illustrative of the invention and is not to be construed as limiting the invention. Various modifications and applications may occur to those skilled in the art without departing from the true spirit and scope of the invention.

I claim as follows:

1. A multi-faceted gem cut with a table; a girdle; a base; and a main point culet, said main point culet being defined on said base by the intersection of a vertical plane passing through a longitudinal axis extending, end to end of said gem and a cross-axis at right angles to said longitudinal axis; and at least one additional point culet located on said base between an end of said gem at said girdle and said cross axis; wherein the number of facets extending from the girdle to the point culets exceed the number of point culets.

2. A gem cut in accordance with claim 1 wherein two additional point culets are provided.

3. A gem cut in accordance with claim 1 wherein said gem is provided with a pair of opposed crown end facets; a pair of opposed crown side facets and crown angled facets extending between each end facet and side facet.

4. A gem cut in accordance with claim 3 wherein the number of said angled facets is four.

5. A gem cut in accordance with claim 1 wherein all of said crown facets are step cut.

6. A gem cut in accordance with claim 1, wherein the material between the girdle and the table forms a crown which comprises three step cuts.

7. A gem cut in accordance with claim 1 wherein said additional culets are located on said base and on a vertical plane passing through said longitudinal axis and between a first end edge of said girdle and a vertical plane no further away from said end edge than said cross-axis.

8. A gem cut in accordance with claim 1 wherein said end base facet is provided with a pair of opposed, end base split facets.

9. A gem cut in accordance with claim 1 wherein the basic shape of said gem is a pear.

10. A gem cut in accordance with claim 1 wherein the basic shape of said gem has a pair of end facets of a shorter dimension than the pair of opposed side facets, said side facets are defined as those parallel to said longitudinal axis.

11. A gem cut in accordance with claim 1 wherein bow-tie like, split facets are provided to the base.

12. A gem cut in accordance with claim 1 wherein said girdle comprises eight straight edges defining an octagon symmetrical about said longitudinal and cross-axis.

13. A gem cut in accordance with claim 10 wherein a pair of opposed end edges are parallel to one another.

14. A gem cut in accordance with claim 10 wherein said side edges are parallel.

15. A gem cut in accordance with claim 1 wherein said crown facets and said base facets are symmetrical about a vertical plane passing through said longitudinal axis.

16. A gem cut in accordance with claim 15 wherein said crown facets and base facets are symmetrical about a vertical plane passing through said cross axis.

17. A gem cut in accordance with claim 1 wherein said gem is a diamond.

18. A gem cut in accordance with claim 1 wherein said end base facets are at an angle of about 41° with respect to said table.

19. A gem comprised of a plurality of crown facets; a plurality of base facets; said crown facets being separated from said base facets by a girdle; said base facets forming a base; said base being provided with a first point culet located along the longitudinal axis of symmetry of said gem and at least one additional point culet, also located along the line of symmetry on said longitudinal axis; and, for each additional culet, an additional base facet extending between said girdle and said additional point culet, wherein the number of facets extending from the girdle to the point culets are greater than two times the number of point culets.

20. A gem in accordance with claim 19 wherein said additional base facet is bordered by a pair of opposed, end base split facets.

21. A gem as claimed in claim 19 wherein two additional culets are provided, equidistant from said first culet.

22. A gem as claimed in claim 19 wherein said additional culets are located between said first culet and the end edges of said girdles.

23. A gem as claimed in claim 19 wherein side split facets are provided.

24. A gem as claimed in claim 19 wherein said girdle has eight edges.

25. A gem as claimed in claim 19 wherein said additional base facets are at an angle of about 41° to said table.

* * * * *